US006911089B2

(12) United States Patent
Latvis

(10) Patent No.: US 6,911,089 B2
(45) Date of Patent: Jun. 28, 2005

(54) SYSTEM AND METHOD FOR COATING A WORK PIECE

(75) Inventor: Steven D. Latvis, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/286,244

(22) Filed: Nov. 1, 2002

(65) Prior Publication Data

US 2004/0083957 A1 May 6, 2004

(51) Int. Cl.[7] ..... B05C 11/10

(52) U.S. Cl. ..... 118/667; 118/666; 118/680; 118/712; 156/359

(58) Field of Search ..... 118/666, 667, 118/680, 683, DIG. 11, 712, 323; 156/356, 357, 359, 378, 392

(56) References Cited

U.S. PATENT DOCUMENTS

| | | | |
|---|---|---|---|
| 2,457,843 A | 1/1949 | Strickland, Jr. | 174/47 |
| 2,483,301 A | 9/1949 | Roberds | 174/15 |
| 2,817,066 A | 12/1957 | Scarpa | 336/84 |
| 2,988,804 A | 6/1961 | Tibbetts | 29/155.57 |
| 3,022,368 A | 2/1962 | Miller | 174/15 |
| 3,492,453 A | 1/1970 | Hurst | 219/10.49 |

(Continued)

OTHER PUBLICATIONS

Mannings U.S.A. Brochure—"Induction Bolt Heating Services".

Superheat Services, Inc. Brochure—"On Site Heat Treatment Specialists".

400 Cycle Induction Heating with proportional control for Preheating and Stress Relieving of Welding Joints, Hobart Brothers Co.

Installation, Operation, and Maintenance for High Frequency Induction Heaters, Hobart Brothers Co.

*Primary Examiner*—J. A. Lorengo
*Assistant Examiner*—George Koch
(74) *Attorney, Agent, or Firm*—Fletcher Yoder

(57) ABSTRACT

A method and apparatus for coating a work piece. The system comprising an applicator adapted to travel over a portion of the work piece. The system being operable to heat the work piece and/or apply a coating onto the work piece as the applicator travels over the work piece. The system may comprise an induction heating system to heat the work piece. The system may be adapted to apply a variety of coatings, such as a liquid coating and a dry powder coating. The applicator being operable to heat the work piece prior to applying the coating or heating the work piece after the coating has been applied. The applicator may also be adapted to apply heat to heat shrink a coating material onto the work piece.

20 Claims, 6 Drawing Sheets

U.S. PATENT DOCUMENTS

| | | | | |
|---|---|---|---|---|
| 3,535,597 | A | | 10/1970 | Kendrick ..... 317/155.5 |
| 3,764,725 | A | | 10/1973 | Kafka ..... 174/15 |
| 3,946,349 | A | | 3/1976 | Haldeman, III ..... 336/62 |
| 4,317,979 | A | | 3/1982 | Frank et al. ..... 219/10.77 |
| 4,339,645 | A | | 7/1982 | Miller ..... 219/10.49 |
| 4,355,222 | A | | 10/1982 | Geithman et al. ..... 219/10.57 |
| 4,392,040 | A | | 7/1983 | Rand et al. ..... 219/10.71 |
| 4,527,032 | A | | 7/1985 | Young et al. ..... 219/10.61 |
| 4,527,550 | A | | 7/1985 | Ruggera et al. ..... 128/1.5 |
| 4,549,056 | A | | 10/1985 | Okatsuka et al. ..... 219/10.77 |
| 4,578,552 | A | | 3/1986 | Mortimer ..... 219/10.41 |
| 4,761,528 | A | | 8/1988 | Caillaut et al. ..... 219/10.491 |
| 4,794,220 | A | | 12/1988 | Sekiya ..... 219/10.491 |
| 4,900,885 | A | | 2/1990 | Inumada ..... 219/10.55 B |
| 4,942,279 | A | | 7/1990 | Ikeda ..... 219/10.75 |
| 4,963,694 | A | | 10/1990 | Alexion et al. ..... 174/15.6 |
| 4,975,672 | A | | 12/1990 | McLyman ..... 336/198 |
| 5,004,865 | A | | 4/1991 | Krupnicki ..... 174/15.7 |
| 5,101,086 | A | | 3/1992 | Dion et al. ..... 219/10.491 |
| 5,113,049 | A | | 5/1992 | Border et al. ..... 219/10.79 |
| 5,185,513 | A | | 2/1993 | Pacileo ..... 219/497 |
| 5,186,755 | A | * | 2/1993 | Carlson, Jr. et al. ..... 118/641 |
| 5,313,037 | A | | 5/1994 | Hansen et al. ..... 219/632 |
| 5,343,023 | A | | 8/1994 | Geissler ..... 219/661 |
| 5,352,292 | A | * | 10/1994 | Thomas ..... 118/669 |
| 5,461,215 | A | | 10/1995 | Haldeman ..... 219/677 |
| 5,504,309 | A | | 4/1996 | Geissler ..... 219/663 |
| 5,676,857 | A | | 10/1997 | Parker ..... 219/61 |
| 5,708,253 | A | | 1/1998 | Bloch et al. ..... 219/130.01 |
| 5,713,130 | A | * | 2/1998 | Fukuda et al. ..... 29/897.3 |
| 5,981,906 | A | | 11/1999 | Parker ..... 219/137 PS |
| 6,043,471 | A | | 3/2000 | Wiseman et al. ..... 219/662 |
| 6,124,581 | A | | 9/2000 | Ulrich ..... 219/665 |
| 6,229,126 | B1 | | 5/2001 | Ulrich et al. ..... 219/635 |
| 6,265,701 | B1 | | 7/2001 | Bickel et al. ..... 219/617 |
| 6,316,755 | B1 | | 11/2001 | Ulrich ..... 219/665 |
| 6,346,690 | B1 | | 2/2002 | Ulrich et al. ..... 219/635 |
| 6,440,245 | B1 | * | 8/2002 | Culzoni et al. ..... 156/94 |

* cited by examiner

SYSTEM AND METHOD FOR COATING A WORK PIECE

FIELD OF THE INVENTION

The present technique relates generally to systems and methods for applying a coating to a work piece. More specifically, the present technique relates to a system and method for applying heat to facilitate the application of a coating to a work piece.

BACKGROUND OF THE INVENTION

In many areas of manufacturing, products are coated with a protective coating. The protective coating may be used to prevent corrosion, damage from scratching, etc. Some protective coatings are air-dried to cure the coating. However, heat may also be used to cure a coating. There are many types of coating materials and types. For example, there are liquid coatings and dry granular coatings. Coatings may require heat to set/cure the coating. The heat may be applied before or after the coating is applied.

Methods of heating a work piece to set/cure a coating include flame heating, resistive heating elements, and induction heating. With flame heating, a torch is used to apply heat to the work piece. However, it is difficult, if not impossible, to accurately control the temperature of the work piece/coating using this method. Therefore, the coating may not cure or set properly. Resistance heating methods produce a flow of electrical current through a heating element to produce the heat. Typically, the resistive heating element is placed on the work piece to enable heat to be transferred to the work piece by conduction. Thus, the resistive heating elements must be removed before applying the coating to the surface. In addition, once the resistive heating elements reach their steady-state temperatures, they typically must be allowed to cool before they can be removed from the work piece. This may add considerable time to the coating process. Typically, induction heating systems utilize a clam-shell design that extends over the work piece. However, these clam-shell design typically are large and cumbersome and also must be removed to enable the coating to be applied.

There is a need, therefore, for a technique for coating a work piece and for applying heat to cure or set the coating that does not have the problems associated with the techniques described above. Specifically, there is a need for a technique to enable a work piece to be heated and a coating applied "on-the-fly."

SUMMARY OF THE INVENTION

The present technique provides a novel approach designed to respond to some or all of these needs. The technique provides an induction heating system adapted to heat a work piece "on-the-fly." The technique also may provide a system having an applicator adapted to apply a coating to the work piece. In one embodiment of the present technique, the system is adapted to apply a wet coating to the work piece. In another embodiment, the system is adapted to provide a dry coating to the work piece. The technique also may be adapted to apply heat to heat shrink a coating onto a work piece.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
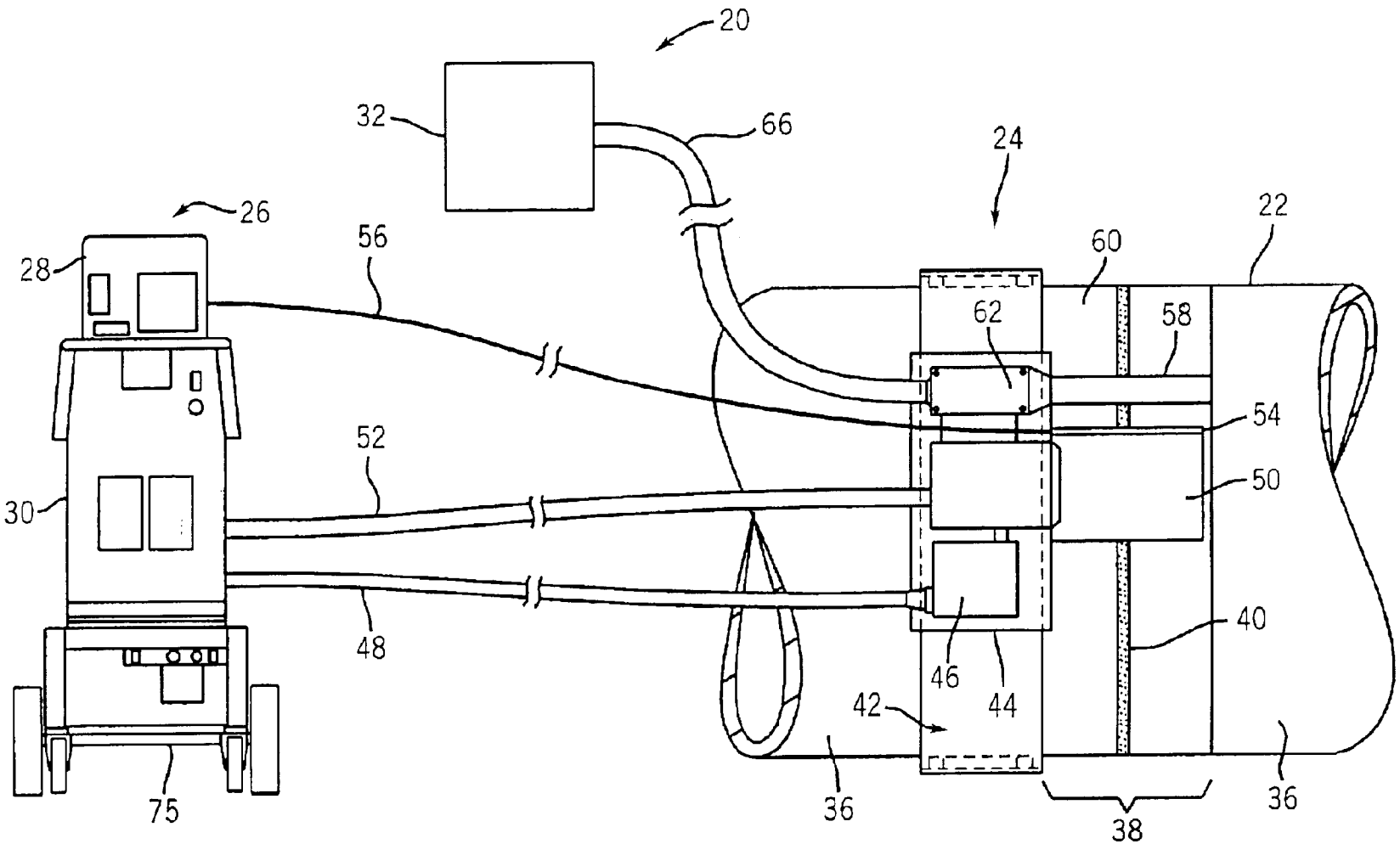
FIG. 1 is a coating system adapted to travel around a work piece, such as a section of pipeline to heat the section and apply a layer of coating thereto, according to an exemplary embodiment of the present technique.

Referring generally to FIG. 1, a system 20 for heating and applying a coating to a work piece on-the-fly is illustrated. In the illustrated embodiment, the work piece is a section of pipeline 22. However, the present technique may be used with a work piece other than a pipeline. In the illustrated technique, rather than heating an entire section of a pipeline and then applying a coating to the section of the pipeline 22, the illustrated system 20 is adapted with a movable applicator 24 adapted to travel around the pipeline 22, preheating a region of the pipeline 22 and then applying a layer of coating to the region as the applicator 24 is moved around the pipeline 22. In this embodiment, the applicator 24 is adapted to preheat the pipeline 22 prior to applying the coating. However, the applicator 24 may also be adapted to apply the coating to the region of the pipeline 22 before the heat is applied to the pipeline 22. With work pieces other than a pipeline, the system may be adapted to rotate the work piece, rather than the applicator 24.

The system 20 also comprises a heating system 26 coupled to the applicator 24 to enable the applicator 24 to heat the pipeline 22. In the illustrated embodiment, the heating system 26 is an induction heating system. However, other types of heating systems may be used, such as an infrared heating system adapted to radiate infrared energy into the work piece. In this embodiment, the heating system 26 comprises a temperature controller 28 and an induction heating power source 30. In addition, the system 20 also comprises a coating reservoir 32 coupled to the applicator 24 to provide the coating for the pipeline 22.

As illustrated, during assembly, the pipeline 22 has a coated portion 36 and an uncoated portion 38. The uncoated potion 38 is comprised of the uncoated ends of adjoining pipe sections. The uncoated portion 38 also comprises the weld 40 joining the adjacent pipe sections. The applicator 24 is adapted to provide a layer of coating to the uncoated portion 38 of the pipeline 22. In this embodiment, the applicator 24 has a track band 42 that is disposed circumferentially around the pipeline 22. This embodiment of the applicator 24 also comprises a carriage or bug 44 adapted to travel circumferentially around the pipeline 22 on the track band 42. General examples of carriages and bugs adapted to travel around a pipeline are presented in U.S. Pat. No.

5,676,857, entitled "METHOD OF WELDING THE END OF A FIRST PIPE TO THE END OF A SECOND PIPE," issued on Oct. 14, 1997; U.S. Pat. No. 5,981,906, entitled "METHOD OF WELDING THE ENDS OF PIPE TOGETHER USING DUAL WELDING WIRES," issued on Nov. 9, 1999; and U.S. Pat. No. 6,265,707 B1, entitled "METHOD AND APPARATUS FOR INDUCTIVE PRE-HEATING AND WELDING ALONG A WELD PATH," issued on Jul. 24, 2001, which are hereby incorporated herein by reference. In this embodiment, a motor 46 is disposed on the carriage 44 to drive the carriage 44 around the pipeline 22. A power cable 48 is coupled to the induction heating power source 30 to provide power to the motor 46. However, power may be provided to the motor 46 from another source of power. The illustrated system 20 may be assembled to coat one uncoated portion of a pipeline and then disassembled and moved to coat another uncoated portion of the pipeline 22.

The induction heating system 26 also comprises an induction head 50 that is secured to the carriage 44 and coupled to the induction heating power source 30 by an induction heating cable 52. The induction heating power source 30 provides a flow of AC current through the induction heating cable 52 and induction head 50 to produce a varying magnetic field. The varying magnetic field produces eddy currents in the uncoated portion 38 of the pipeline 22. The eddy currents, in turn, increase the temperature of the uncoated portion 38 of the pipeline 22. In this embodiment, the induction head 50 is adapted to extend over the uncoated portion 38 of the pipeline 22. In addition, the induction head 50 comprises a coil adapted to direct the magnetic field toward the uncoated portion 38 of the pipeline 22. The coil may be comprised of a solid metal coil. The coil also may be formed from a cable or be non-circular.

The induction heating power source 30 produces a current having a high frequency, such as a radio frequency. However, at high frequencies the current carried by a conductor is not uniformly distributed over the cross-sectional area of the conductor, as is the case with DC current. This phenomenon, referred to as the "skin effect", is a result of magnetic flux lines that circle part, but not all, of the conductor. At radio frequencies, approximately 90 percent of the current is carried within two skin depths of the outer surface of a conductor. For example, the skin depth of copper is about 0.0116 inches at 50 KHz, and decreases with increasing frequency. The reduction in the effective area of conduction caused by the skin effect increases the effective electrical resistance of the conductor. In the illustrated embodiment, the induction heating cable 52 utilizes a litz wire (not shown) to produce the magnetic fields. The litz wire is used to minimize the effective electrical resistance of the induction heating cable 52 at high frequencies. A litz wire utilizes a large number of strands of fine wire that are insulated from each other except at the ends where the various wires are connected in parallel. The individual strands are woven in such a way that each strand occupies all possible radial positions to the same extent. In the illustrated embodiment, the induction head 50 and cable 52 are air-cooled. However, the induction head 50 and induction heating cable 52 may be adapted to be fluid-cooled. The induction heating power source 30 may be adapted to provide a cooling fluid for the induction head 50 and induction heating cable 52.

In the illustrated embodiment, the temperature controller 28 receives temperature data from a temperature detector 54 adapted to measure the temperature of the region of the pipeline 22 being heated by the induction head 50. However, the temperature detector 54 may be adapted to detect temperature from another portion of the pipeline 22, such as the area forward of the coating applicator. Preferably, the temperature detector 54 is a non-contact temperature detector, such as an infrared-sensing temperature detector. In this embodiment, the temperature data is coupled to the temperature controller 28 by a cable 56. The temperature controller 28 may be programmed to produce a desired temperature in the region of the pipeline 22 being heated.

There are a number of ways of operating the system to establish a desired temperature in a portion of the pipeline 22. In this embodiment, the induction heating power source 30 is adapted to provide a constant output and the temperature controller 28 is adapted to establish the desired temperature in the portion of the pipeline 22 by controlling the movement of the induction head 50 relative to the pipeline 22. For example, for a given output from the induction head 50, the slower the movement of the induction head 50 around the pipeline 22, the greater the increase in temperature of the region of the pipeline 22 proximate to the induction head 50. The motor 46 may be operated to provide a relatively constant speed around the pipeline 22 or the motor 46 may be selectively started and stopped to achieve a desired temperature in the pipeline 22. Alternatively, the temperature controller 28 may be adapted to vary the output of the induction power source 30 to achieve a desired temperature in the portion of the pipeline 22 prior to applying the coating. Indeed, the system 20 may be designed for open-loop operation, that is, it may not have a temperature detector 54 and temperature controller 28. For example, the output of the induction power source 30 may be established to produce a desired temperature in the pipeline 22 for a given speed of the motor 46. In addition, the motor 46 may be provided with a motor controller, such as a potentiometer, that allows the speed of the carriage to be manually set to a desired speed.

In the illustrated embodiment, the applicator 24 also comprises a coating applicator 58 adapted to deposit a layer of coating 60 on the pipeline 22. In this embodiment, the coating 60 is a liquid and the coating applicator 58 is adapted to spray the liquid coating 60 onto a portion of the uncoated portion 38 of the pipeline 22. A pump 62 is provided to pump the liquid coating 60 from the coating reservoir 32 to the coating applicator 58. However, the pump 62 may be disposed in another location, such as the coating reservoir 32. A hose 66 is provided to couple the coating 60 from the reservoir 32 to the pump 62. However, the coating 60 may also be a dry powder coating. In addition, the coating reservoir 32 may be secured to the applicator 24 to travel with the carriage 44. In the embodiment illustrated, the track band 42 and carriage 44 are oriented on the pipeline 22 so that the induction head 50 leads the coating applicator 58 as the carriage 44 travels around the pipeline 22, to enable the induction head 50 to preheat the pipeline 22 before the application of coating 60 to the pipeline 22. However, the track band 42 and carriage 44 may be disposed on the pipeline 22 to enable the coating applicator 58 to lead the induction head 50, to enable the induction head 50 to heat the pipeline 22 after the coating 60 has been applied. Alternatively, the motor 46 may be adapted to change the direction of travel of the carriage 44 around the track band 42.

Figure 2:
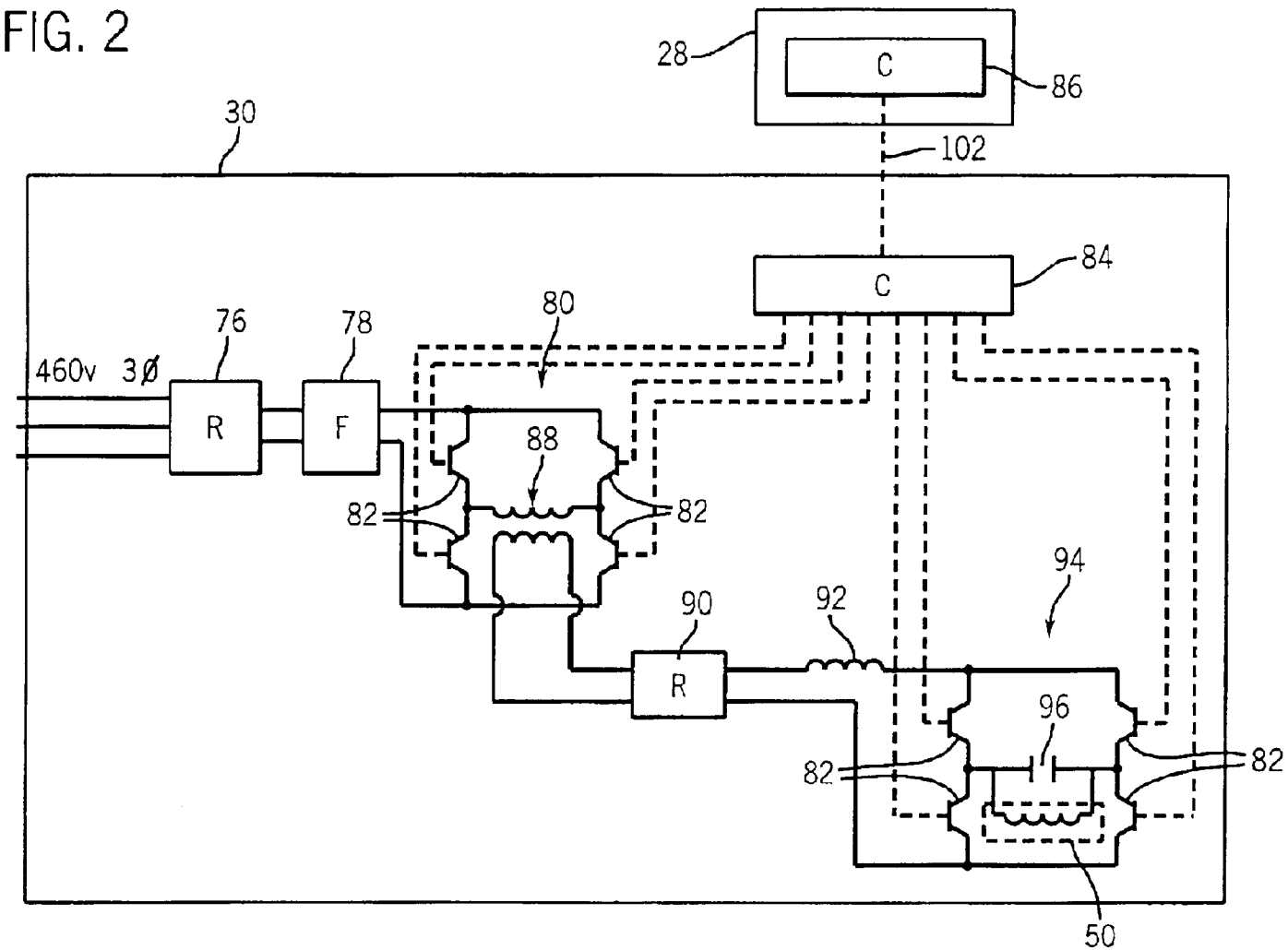
FIG. 2 is an electrical schematic diagram of an induction heating system, according to an exemplary embodiment of the present technique.

Referring generally to FIG. 2, an electrical schematic of a portion of the induction heating power system 26 is illustrated. In the illustrated embodiment, 460 Volt, 3-phase AC input power is coupled to the power source 30. A line source or a generator may provide the input power. A rectifier 76 is used to convert the AC power into DC power. A filter 78 is used to condition the rectified DC power signals. A first inverter circuit 80 is used to invert the DC power into desired AC output power. In the illustrated embodiment, the first inverter circuit 80 comprises a plurality of electronic switches 82, such as IGBT's. Additionally, in the illustrated embodiment, a controller board 84 housed within the power source 30 controls the electronic switches 82. Control circuitry 86 within the controller 28 in turn, controls the controller board 84.

A step-down transformer 88 is used to couple the AC output power from the first inverter circuit 80 to a second rectifier circuit 90, where the AC is converted again to DC. In the illustrated embodiment, the DC output from the second rectifier 90 is, approximately, 600 Volts and 50 Amps. An inductor 92 is used to smooth the rectified DC output from the second rectifier 90. The output of the second rectifier 90 is coupled to a second inverter circuit 94. The second inverter circuit 94 converts the DC output into high-frequency AC signals. A capacitor 96 is coupled in parallel with the induction heating cable 52 across the output of the second inverter circuit 94. The induction head 50, represented schematically as an inductor 98, and capacitor 96 form a resonant tank circuit. The capacitance and inductance of the resonant tank circuit establishes the frequency of the AC current flowing from the power source 30 to the induction head 50. The current flowing through the induction head 50 produces a varying magnetic field that induces current flow, and thus heat, in the pipeline 22.

Figure 3:
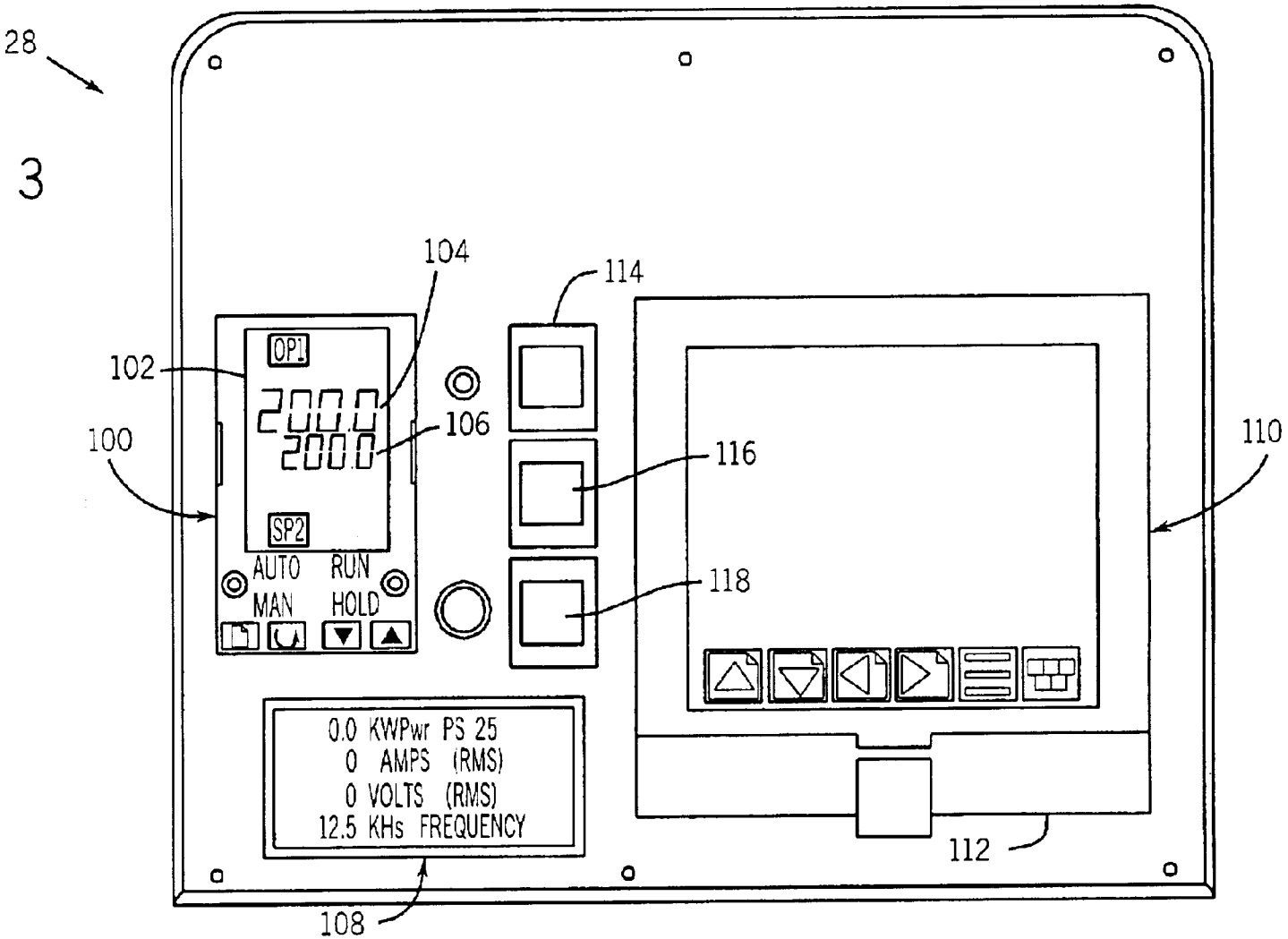
FIG. 3 is a front elevational view of a temperature controller, according to an exemplary embodiment of the present technique.

Referring generally to FIG. 3, as discussed above, the temperature controller 28 may control the system 20 automatically. In the illustrated embodiment, the temperature controller 28 comprises a programmable control unit 100 operable to receive programming instructions to heat the pipeline to a desired temperature. The control unit 100 comprises a display 102 adapted to display the desired temperature 104 and the actual temperature 106 as detected by the temperature detector 54, where provided. The temperature controller 28 also comprises a parameter display 108 adapted to provide induction heating system operating parameter data. For example, the illustrated parameter display 108 is operable to provide a user with the power available from the induction power source 30 and the power currently being provided by the power source 30. The parameter display 108 also is operable to provide a user with an indication of the output current and the output voltage of the power source 30. The parameter display 108 also is operable to provide a user with an indication of the frequency of the AC output current to the inductive head 50. The illustrated temperature controller also is adapted with a digital display 110 adapted to provide temperature data. This embodiment also comprises a hard drive 112 operable to record temperature data.

The temperature controller 28 also comprises a run button 114, a hold button 116, and a stop button 118. Once the system 20 is assembled, the run button 114 may be operated to direct the system 20 to drive the applicator 24 around the pipeline 22, heating the pipeline and applying a layer of coating thereto as the applicator 24 is driven around the pipeline 22. The temperature controller 28 may vary the speed of the applicator 24 to achieve the desired temperature. The hold button 116 may be operated to pause operation of the system 20. The stop button 118 may be operated to halt operation of the system 20.

Figure 4:
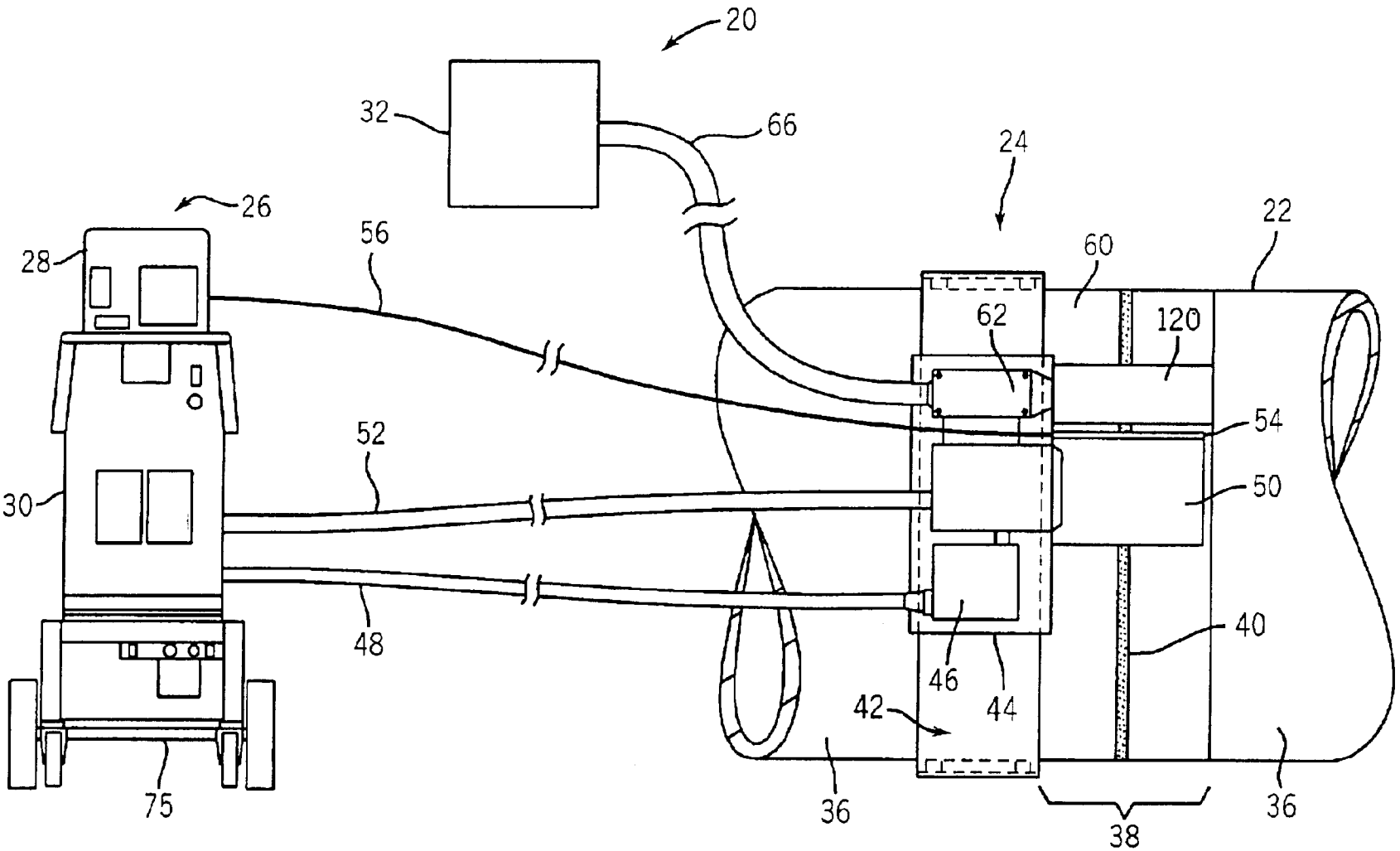
FIG. 4 is an alternative embodiment of the coating system, illustrating a coating roller adapted to dispose a layer of coating onto the section of pipeline.

Referring generally to FIG. 4, an alternative embodiment of a coating applicator 120 is illustrated. In this embodiment, the coating applicator 120 is adapted to roll a dry powder coating onto the uncoated portion 38 of the pipeline 22. However, the coating applicator 120 may also be adapted to roll liquid coating onto the pipeline 22. The induction head 50 is adapted to preheat a section of the uncoated portion 38 of the pipeline. The temperature detector 54 senses the temperature of the pipeline section and directs the movement of the carriage 44 in response to the temperature data. The temperature controller 28 may be programmed to achieve an optimal temperature in the pipeline for setting the coating.

Figure 5:
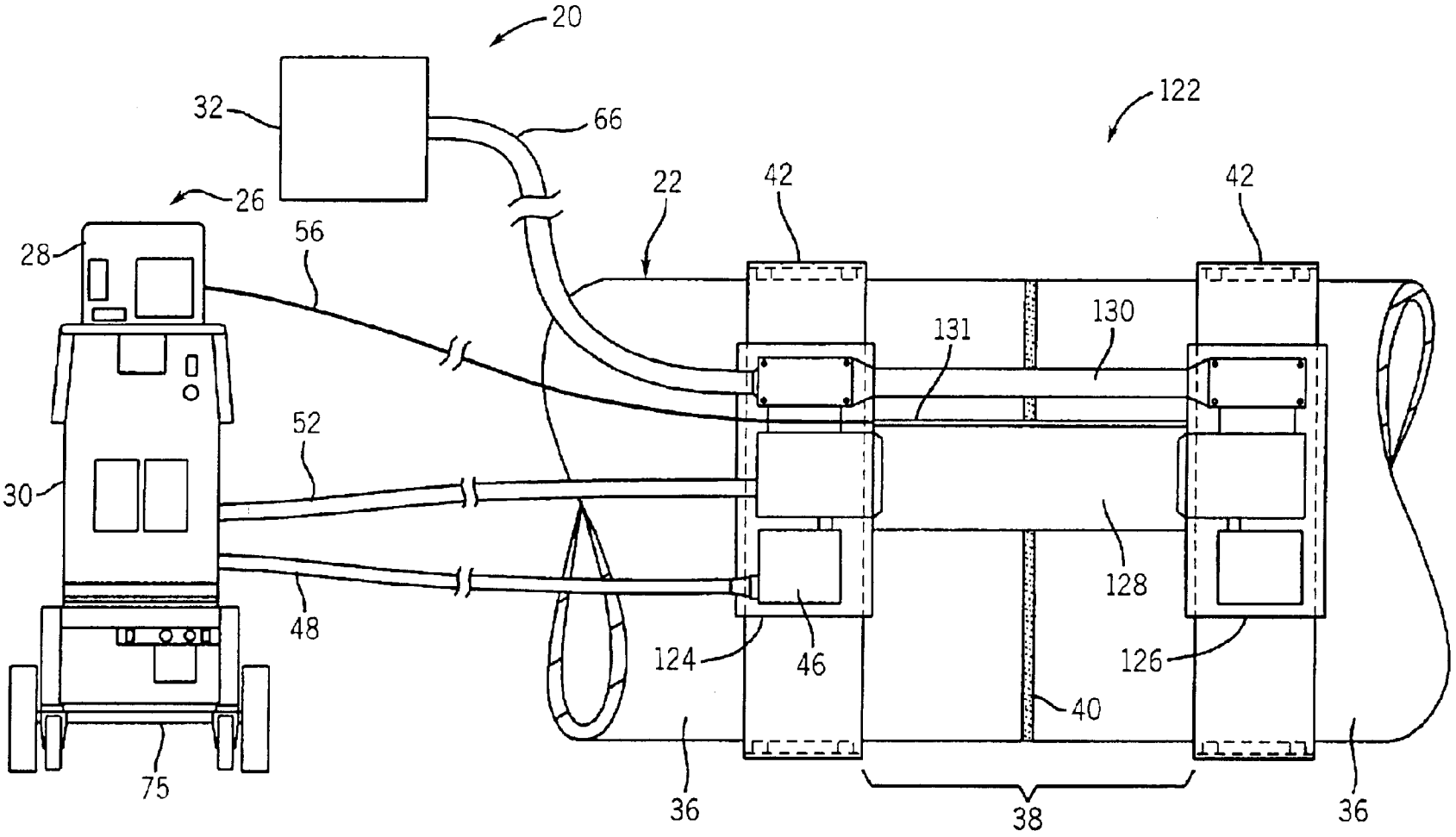
FIG. 5 is a second alternative embodiment of the coating system, illustrating a coating system adapted to extend across a desired portion of a work piece to heat the section and apply a layer of coating thereto.

Referring generally to FIG. 5, an alternative embodiment of an applicator mechanism 122 is illustrated. In the illustrated embodiment, the applicator mechanism 122 is adapted to be supported on both sides of an uncoated portion 38 of a pipeline 22, rather than on a single side. This embodiment utilizes two circumferential track bands 42, one on each side of the uncoated portion 38 of the pipeline 22. A first carriage 124 is disposed on one track band 42 and a second carriage 126 is disposed on the other track band 42. In this embodiment, an induction head 128, a coating applicator 130, and a temperature detector 131 are secured to the first and second carriages 124, 126. Thus, preventing any bending stress in the induction head 128, coating applicator 130, or temperature detector 131 that may be present when only a single carriage is used. In addition, the two-carriage embodiment illustrated may enable a wider region of a work piece to be coated, set, or cured than a single carriage embodiment.

Figure 6:
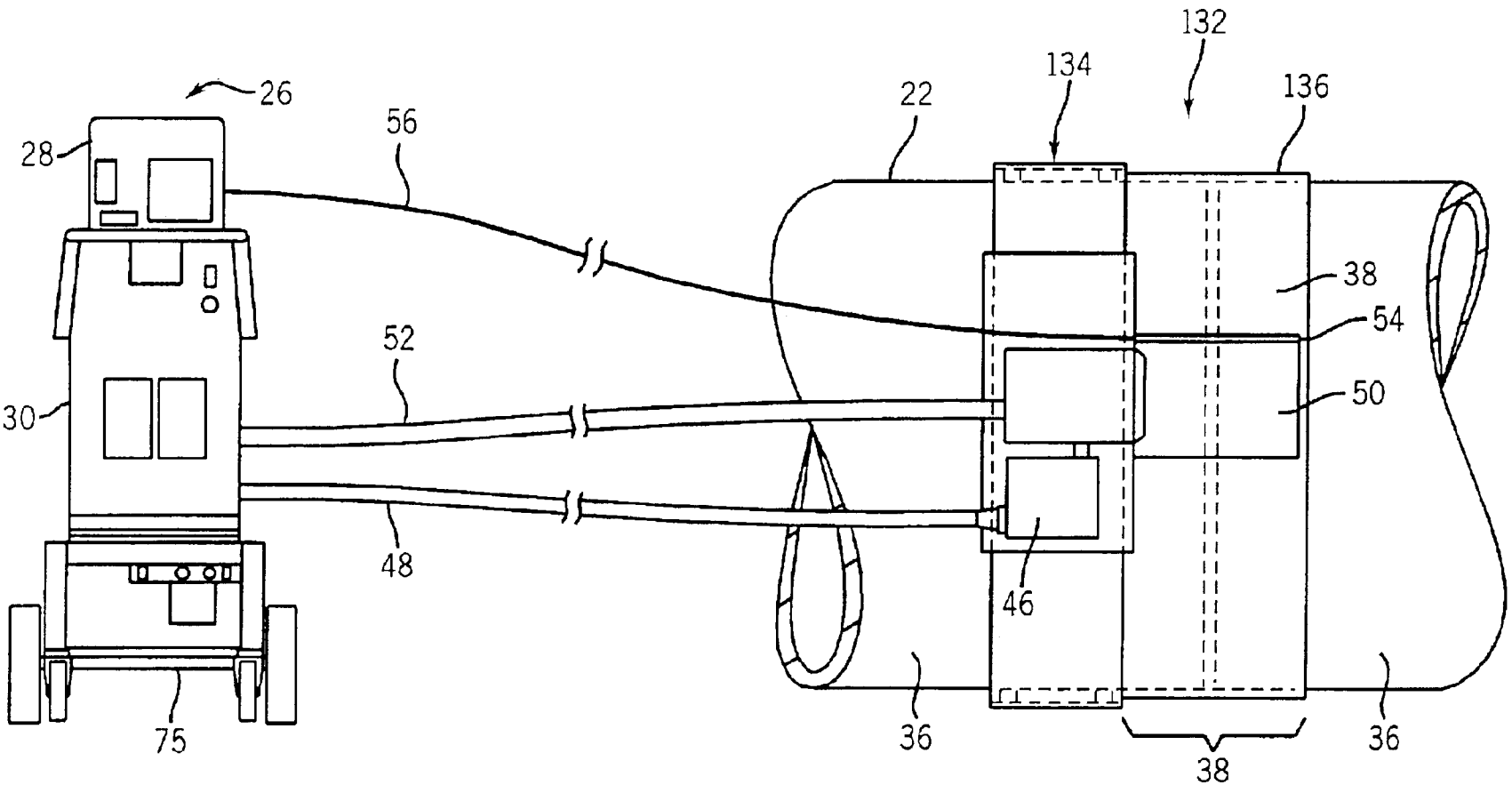
FIG. 6 is a third alternative embodiment of the coating system, illustrating a system adapted to travel around a work piece to apply heat to heat shrink a coating onto the work piece.

Referring generally to FIG. 6, an alternative embodiment of a coating system 132 is illustrated. In this embodiment, the applicator 134 is adapted to heat shrink a section of heat shrink material 136 over an uncoated portion 38 of the pipeline 22. Consequently, the illustrated applicator 132 does not have a coating applicator. A strip of heat shrink material 136 may be disposed over the uncoated portion 38 of the pipeline and heated to join the ends of the strip into a band around the uncoated portions of the pipeline 22. The system 132 may then be operated to heat the pipeline 22 to produce heat to cause the band of heat shrink material 136 to shrink onto the pipeline 22, forming a coating.

It will be understood that the foregoing description is of preferred exemplary embodiments of this invention, and that the invention is not limited to the specific forms shown. Modifications may be made in the design and arrangement of the elements without departing from the scope of the invention as expressed in the appended claims.

What is claimed is:

1. A coating system, comprising:

a coating applicator adapted to apply a coating to a portion of a work piece;

a heating apparatus adapted to increase the temperature of the portion of the work piece;

a temperature detector adapted to detect the temperature of the work piece;

a drive mechanism adapted to position the coating applicator and heating apparatus relative to the work piece; and a temperature controller electrically coupled to the temperature detector and the drive mechanism, wherein the temperature controller is operable to receive a signal representative of work piece temperature from the temperature detector and to provide a signal to the drive mechanism to control the movement of the heating apparatus relative to the work piece based on the signal representative of work piece temperature.

2. The system as recited in claim 1, wherein the heating apparatus is electrically coupleable to an induction power source.

3. The system as recited in claim 1, wherein the coating applicator comprises a device for applying a liquid coating onto the portion of the work piece.

4. The system as recited in claim 1, wherein the temperature detector is disposed intermediate the coating applicator and the heating apparatus.

5. The system as recited in claim 1, wherein the coating system is adapted to heat the portion of the work piece to a desired temperature prior to applying the coating to the work piece.

6. The system as recited in claim 1, wherein the coating applicator comprises a pump adapted to pump coating through the coating applicator.

7. The system as recited in claim 6, comprising a coating reservoir.

8. A system for coating a work piece, comprising:

a coating system comprising an applicator adapted to apply a layer of coating to a portion of the work piece;

a heating system comprising a heating member adapted to increase the temperature of the portion of the work piece; and a drive system adapted to drive the applicator and heating member relative to the work piece, wherein the drive system comprises:

a temperature detector adapted to provide a signal representative of the temperature of the portion of the work piece; and a temperature controller adapted to establish a desired temperature of the portion of the work piece based on the signal representative of the temperature of the portion of the work piece, wherein the temperature controller is adapted to control movement of the heating member relative to the portion of the work piece to establish the desired temperature of the portion of the work piece.

9. The system as recited in claim 8, wherein the heating system comprises an induction heating power source, the heating member comprising an induction head electrically coupled to the induction heating power source to produce a magnetic field to inductively heat the portion of the work piece.

10. The system as recited in claim 8, wherein the temperature detector is an infrared temperature detector.

11. The system as recited in claim 8, wherein the temperature controller is adapted to control heating system output to establish the desired temperature of the portion of the work piece.

12. The system as recited in claim 8, wherein the drive mechanism comprises a track securable to the work piece, a movable member adapted to travel along the track, and a motor adapted to drive the movable member along the track.

13. The system as recited in claim 8, wherein the applicator comprises a spray applicator adapted to spray coating onto the work piece.

14. A coating system, comprising:

a coating applicator;

a drive system securable to a work piece, the drive system being adapted to drive the coating applicator over the surface of the work piece to apply a layer of coating thereto;

a temperature sensor operable to detect work piece temperature; and a heating apparatus adapted to increase the temperature of a portion of the work piece, wherein the drive system is adapted to drive the heating apparatus over the work piece to enable the heating apparatus to heat the work piece to a desired temperature before the coating applicator applies a layer of coating to the work piece, wherein the heating apparatus is configured to receive a signal from the temperature sensor, and wherein the drive system operates in response to the signal.

15. The system as recited in claim 14, wherein the work piece is cylindrical, the drive system comprising a fixed member securable around the circumference of the work piece and a movable member adapted to travel circumferentially around the work piece along the fixed member.

16. The system as recited in claim 14, wherein the heating apparatus is adapted to produce a magnetic field to inductively heat the object.

17. The system as recited in claim 16, comprising an induction heating power source electrically coupled to the heating apparatus.

18. A system for coating an uncoated region of a pipeline, comprising:

a heating apparatus adapted to extend over adjacent uncoated ends of adjoining pipe sections to increase the temperature of the adjacent uncoated ends of adjoining pipe sections;

an applicator adapted to dispose a coating onto the adjacent uncoated ends of adjoining pipe sections;

a drive mechanism adapted to drive the heating apparatus around the pipeline to heat the adjacent uncoated ends of adjoining pipe sections and the applicator to dispose the coating on the adjacent uncoated ends of adjoining pipe sections;

a temperature sensor operable to provide a signal representative of temperature of a portion of at least one of the adjoining pipe sections; and a temperature controller adapted to control one of the induction heating power source and the drive mechanism to establish a desired temperature in the portion of at least one of the adjoining pipe sections, wherein the temperature controller produces a signal to operate the drive mechanism in response to data from the temperature sensor.

19. The system as recited in claim 18, wherein the heating apparatus is adapted to produce a magnetic field to inductively heat the adjacent uncoated ends of adjoining pipe sections.

20. The system as recited in claim 19, comprising an induction heating power source electrically coupleable to the heating apparatus.

* * * * *